US005806264A

United States Patent [19]

Boot

[11] Patent Number: 5,806,264

[45] Date of Patent: Sep. 15, 1998

[54] MULTI-CELLULAR WALL STRUCTURE

[75] Inventor: Phillip Hanford Boot, Turramurra, Australia

[73] Assignee: Phillip Boot Holdings Pty Ltd, North Turramurra, Australia

[21] Appl. No.: 793,132

[22] PCT Filed: Aug. 15, 1995

[86] PCT No.: PCT/AU95/00499

§ 371 Date: May 8, 1997

§ 102(e) Date: May 8, 1997

[87] PCT Pub. No.: WO96/06243

PCT Pub. Date: Feb. 29, 1996

[30] Foreign Application Priority Data

Aug. 19, 1994 [AU] Australia ..... PM7572
Mar. 22, 1995 [AU] Australia ..... PN1876

[51] Int. Cl.[6] ..... E04B 2/14; E04B 2/00

[52] U.S. Cl. ..... 52/415; 52/405.1; 52/405.3; 52/742.14; 52/781.5; 52/793.1

[58] Field of Search ..... 52/793.1, 781.5, 52/764, 424, 475.1, 479, 434, 405.1, 405.3, 742.14, 745.19, 445

[56] References Cited

U.S. PATENT DOCUMENTS

| | | | |
|---|---|---|---|
| 1,021,780 | 4/1912 | Johnson | 52/434 |
| 2,825,221 | 3/1958 | Brouk | 52/479 X |
| 4,031,682 | 6/1977 | Renkert . | |
| 4,164,831 | 8/1979 | Messick et al. | 52/405.3 |
| 4,315,391 | 2/1982 | Piazza . | |
| 4,323,080 | 4/1982 | Mullins | 52/405.3 X |
| 4,548,007 | 10/1985 | Newman | 52/793.1 X |

FOREIGN PATENT DOCUMENTS

| | | |
|---|---|---|
| 74707/87 | 9/1989 | Australia . |
| 1484067 | 12/1968 | Germany . |
| WO8901555 | 2/1989 | WIPO . |
| WO94/19551 | 9/1994 | WIPO . |

*Primary Examiner*—Christopher Kent
*Attorney, Agent, or Firm*—Jacobson, Price, Holman & Srern, PLC

[57] ABSTRACT

A prefabricated reinforced concrete wall structure formed in two parts, the first part including a plurality of walling units spaced apart but in groups over the whole area of the wall, channel shaped spaces between and around the groups of walling elements being configured in a grid formation and being filled by a high strength reinforced concrete cast in and around the group of walling units and constituting a concrete grid as the dominant structural member of the prefabricated wall panel. The walling units and the concrete grid are further supported by a layer of Portland cement based render on both sides of the wall surface, the completed wall structure being significantly lighter in weight and having a lower Portland cement volume in comparison with normal concrete walls of similar structural ability.

8 Claims, 3 Drawing Sheets

MULTI-CELLULAR WALL STRUCTURE

TECHNICAL FIELD TO WHICH THE INVENTION RELATES

The present invention relates to a new type of prefabricated concrete walling that is structurally adjustable to suit many applications and to a method of making same.

The degree of structural flexibility allows this semi walling system to be commercially viable in all types of construction in non, semi and full load bearing applications.

BACKGROUND OF THE INVENTION

Prefabrication of walling is well understood, the most common being made from reinforced concrete in the form of transportable panels. However in actual practice these types of walling systems although speeding up construction have failed to revolutionise the industry and in most cases have been proved to be more expensive than conventional construction, particularly in developing countries.

The main reason for this failure is that these prefabricated systems were designed in developed countries to save on labour skills and labour costs, whereas in developing countries materials costs account for the major portion (up to 80%) of the cost breakdown between materials and labour, which is the reverse of developed countries where labour accounts for the major portion (up to 75%). None of the immense number of building systems so far devised and tried in developing countries has saved enough in materials costs to be effective in those environments and markets which are traditionally masonry oriented. Residential construction in developing countries is almost all masonry type construction, very lightweight plasterboard systems have failed to satisfy consumer requirements.

The relatively high cost of concrete systems is associated with the use and quantity required of Portland cement to make construction quality concrete. Portland cement accounts for approximately 75% of the total cost of structural concrete and therefore any reasonable cost reductions to be made in concrete costs must be associated with a significant reduction in cement content.

Portland cement is also a very slow hardening binder, preventing rapid reuse of expensive moulding and other production equipment. Various methods have been devised to speed up the hardening process such as, steam curing, hot water mixing, intense vibration, low water/cement ratios, accelerators, accompanied always with a higher cement content than would normally be required if the concrete were cast in situ on the construction site with several weeks in time to achieve structural maturity.

Unfortunately all of these measures to gain sufficient early strength add significant cost onto prefabricated products either directly or indirectly through higher capital costs or higher material costs, and yet, the most economical method will only yield product every 24 hours and with very high cement contents every 12 hours.

Unless a manufacturing cycle of 12 hours or less can be achieved the benefits of prefabrication are largely negated as factories become disproportionably large and costly, in addition, the production of product is too slow to fulfill the real potential of prefabrication techniques. Most reinforced concrete structures are designed to achieve adequate strength in 28 days and reducing this time down to a matter of hours is costly.

These higher capital costs are associated with long cycle times ie, equipment reuse and factory space become critical because prefabricated concrete products have to be strong enough within 12 hours to withstand the stresses of de-moulding and handling. In order to achieve this cycle time criteria the product is manufactured to a much higher degree of strength than is required for it's use as a normal structural element in a building.

These factors are further exacerbated by the weight of the prefabricated product being produced create more stress around the lifting zones during de-moulding. The lighter the product, the less stress and the less cement hydration (hardening) is required.

Although there are some cases where the extra costs of the prefabricated systems are justified such as rapid multi storey construction or unavailability of suitable labour, these situations are not normal or common in developing countries.

However in most cases these extra costs associated with shorter de-moulding cycles make the product uneconomical as the optimum strength of the product when cured and installed in the building structure is up to 80% redundant or excessive over what is required to support that structure and therefore remains unused or wasted.

The product described herein illustrates how it is possible to produce a prefabricated low cost concrete walling system that,

- Has a low overall Portland cement content subsequent low materials cost;
- Uses relatively inexpensive moulds;
- Can be de-moulded after 8 hours curing, giving a 12 hour cycle or less;
- Does not require vibration of the mould during manufacture;
- Does not require steam curing;
- Is structurally adjustable to suit almost any application thus reducing waste;
- Does not have a significant strength redundancy factor after installation on site;
- Weighs significantly less than a normal reinforced concrete wall panel; and
- Does not need panels to be repetitively produced for economies of scale.

The above qualities are achieved without the use of special or exotic and expensive binders, instead normal Portland cement and conventional materials are used. The problem of strength gain to facilitate early de-moulding is overcome by concentrating the cement requirement into a minor strategically placed percentage of the volume of the prefabricated walling unit.

Normal reinforced concrete walling is made up of various constituents eg., Portland cement, aggregates, water and reinforcing steel, moulded in one process to form the wall and to perform as closely as possible to a homogeneous product. In it's preferred form the invention described herein is formed in two or more separate processes or stages and performs as a heterogeneous product.

Non load bearing walls perform only one main function ie, to simply act as sides of a room, this is called the walling function. Structural load bearing walls perform two functions, they support roof and upper floor loads, resist horizontal forces which is the structural function and act as the sides of rooms which is the walling function, however in nearly every building the requirements for the structural function as against the simple room walling function vary considerably.

An example of this would be a normal two storey house with a truss designed roof structure in which all the internal and external ground floor walls supporting the first floor and roof are obviously structural load bearing panels, however the internal walls on the upper floor are only semi structural non load bearing as they simply divide the rooms and the external walls on the upper floor are structural load bearing as they support the truss roof structure and resist wind forces, all these walls perform different functions to a different degree.

In this example it can be seen that there is always a requirement for variation by degree of structural and semi structural walling in each individual wall in almost every building structure and also a varying degree of structural requirement at every floor level depending on how much load is carried by each individual wall.

As structural safety is the more critical function the design and manufacture of structural walling is dictated to by the worst case scenario or the highest stressed part of any structural walling. This leads to over design by engineers and results in a large degree of redundant strength in most structural walling as it has not been economical to specifically structurally design each wall panel, invariably the lowest common denominator becomes the most highly stressed or loaded wall.

When this factor is added to the previously described problems associated with short moulding cycles, strength and over design redundancy factors add enough to the cost of prefabrication to render it uneconomical in most general cases.

This specification describes how buildings can be designed and low cost prefabricated wall panels manufactured to suit varying structural requirements on an individual or structurally graded basis and can be demoulded within a 12 hour cycle or less.

By separating the manufacturing process into two or more separate processes, the separate functions of the structural walling described above can be specifically addressed and designed individually to suit any requirement within the same building.

In order to achieve this two stage process the completed prefabricated walling panel in accordance with this invention is made up of two basic separate parts, a walling function part and a structural function part, these parts are manufactured in a two or more staged process, the first stage of manufacturing is the production of walling units to perform the walling function and the second stage is the manufacture of a high strength reinforced concrete structural grid or frame which performs the structural function.

The first stage of the process consists of manufacturing a plurality of walling units, these can be made of any suitable material strong enough to perform the walling function as specified. In manufacturing these walling units the preferred form is of hollow concrete block shape, the preferred material would be Portland cement mixed with aggregates and the preferred method of manufacture is by an extrusion method similar to that used by a concrete block making machine.

Because the walling units only need to perform the walling function they can be manufactured of relatively weak materials or a very low cement content. It is only the size and group placement configuration of these walling units that determine the configuration of the grid which is the structural element in this walling system.

By using a variety of pre-determined configurations for the grouping of the walling units the structural grid is automatically designed because the positioning of the walling elements dictate the structural grid configuration which is almost completely variable. Additionally the relatively small walling units are positioned by a programme similar to a finite element analysis that dictates the structural requirement for each wall panel or even each relevant part of each wall panel.

In a more basic application an engineer could simply select a suitable structural variation for each panel or part panel, depending on the building structure design criteria, so that a building would be made of up a variety of structural grades of panels, this, coupled with the manufacturing process eliminates the lowest common denominator criteria and excessive cost of over design described earlier on.

The wall panels would then be manufactured to the engineers design simply by the selection of the suitable configuration of positioning of the walling units, producing the desired structural and walling design result.

Engineers could also design for earlier de-moulding by forming a truss or beam with the reinforced concrete grid configuration at the tope of the wall panel, this would act in a manner similar to that of a spreader beam and distribute stresses. One type of configuration is illustrated in the attached drawings and shows how this beam could assist in transferring and directing loads and stresses to the desired locations, this is an important feature of this system.

SHORT SUMMARY OF THE INVENTION

The invention consists in a prefabricated reinforced concrete wall structure formed in two main parts, the first part consisting of a plurality of walling units spaced apart but in groups over the whole area of the wall, channel shaped spaces between and around the groups of walling elements being configured in a grid formation and being filled by a high strength reinforced concrete cast in and around the said group of walling units and constituting as a second part a concrete grid as the dominant structural member of the prefabricated wall panel the walling units and the concrete grid are further supported by a layer of Portland cement based render on both sides of the wall surface, the completed wall structure in weight and having a lower Portland cement content in comparison with a solid prefabric coated normal concrete wall. The invention further consists in a method of manufacturing the prefabricated reinforced wall structure.

BRIEF EXPLANATION OF THE DRAWINGS

In order that the invention may be better understood and put into practice preferred embodiments of the invention are shown, by way of example, in the accompanying drawings in which.

BEST MODE OF PERFORMING THE INVENTION

Figure 1:
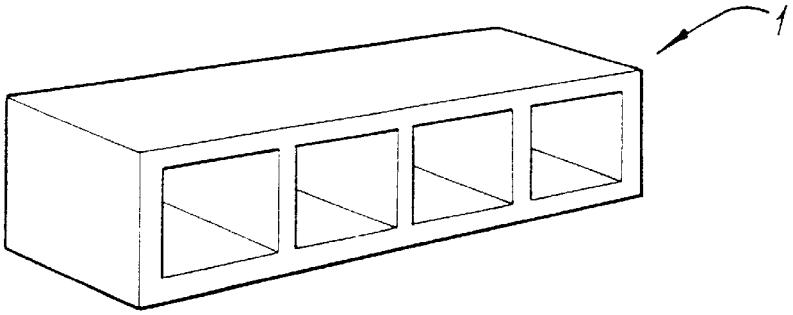
FIG. 1 shows a typical masonry type walling unit.
Figure 2:
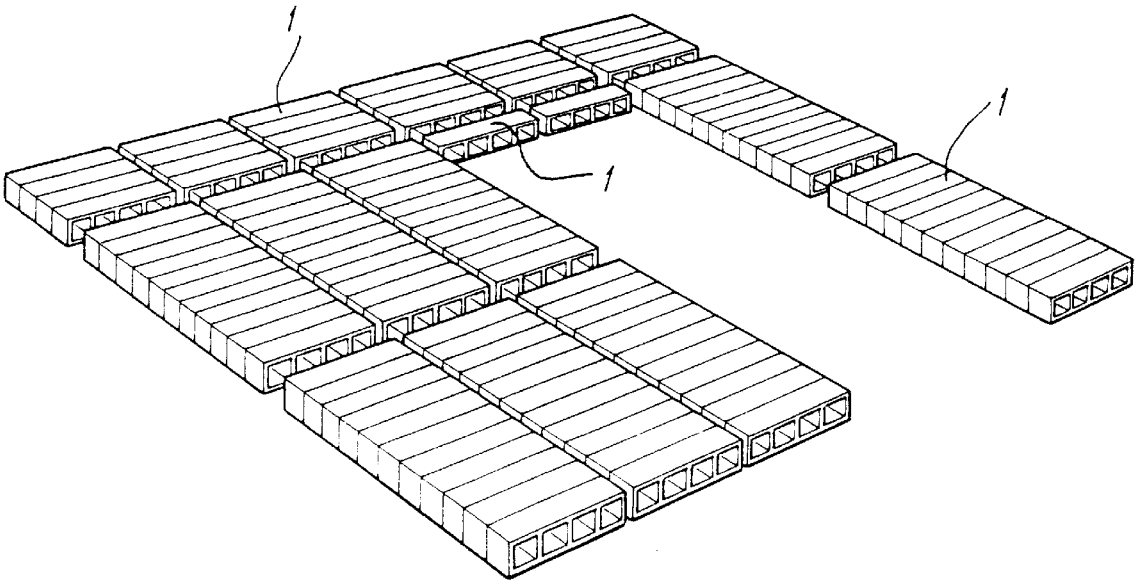
FIG. 2 is an isometric drawing of walling units laid out on a table in the form of a large panel with a large door opening.
Figure 3:
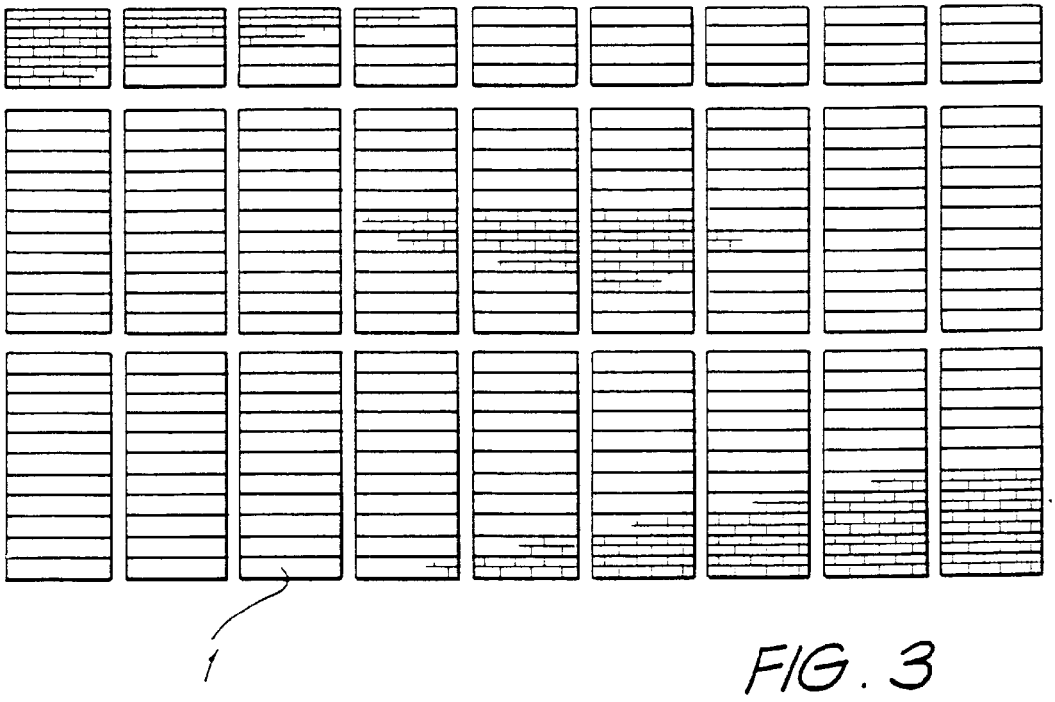
FIG. 3 is a plan view showing wall units 1 laid out on a flat table with channel shaped spaces created between the units defining the cellular grid 4.
Figure 4:
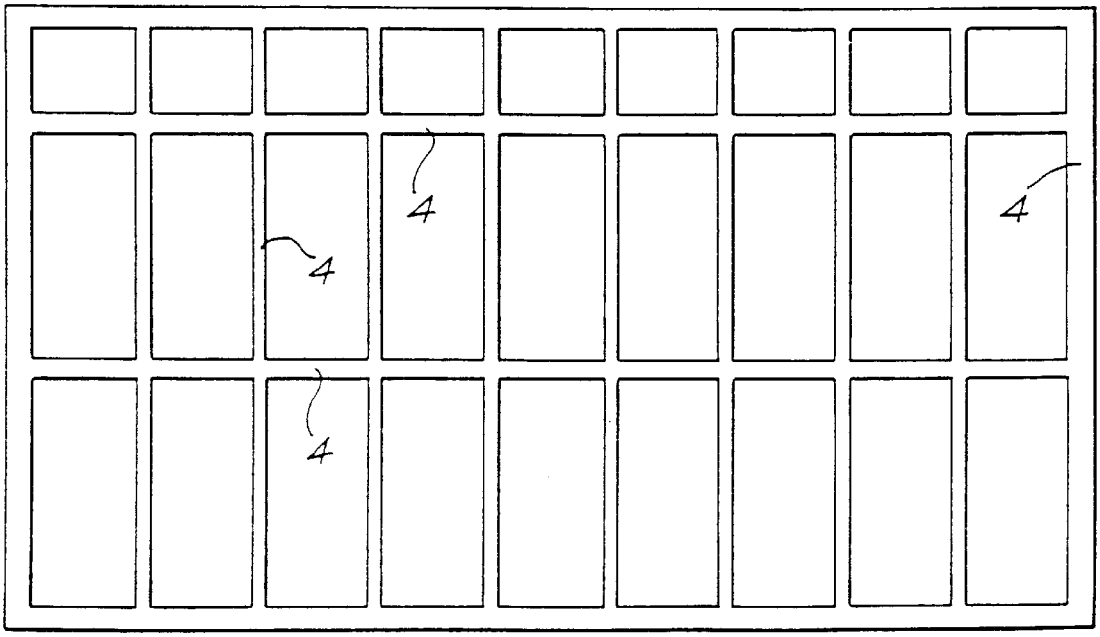
FIG. 4 is the cellular grid created by the arrangement of walling units in FIG. 3.
Figure 5:
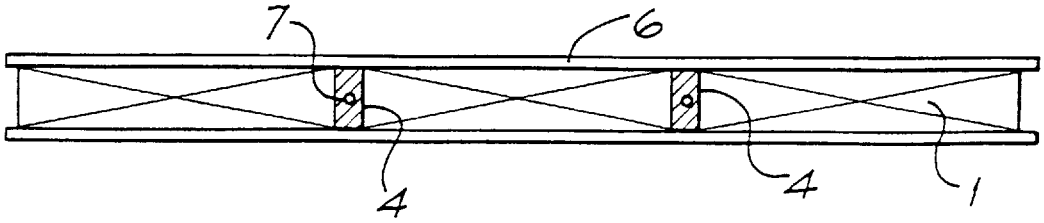
FIG. 5 is a section of a cellular grid wall showing the separate elements with the walling units 1.
Figure 6:
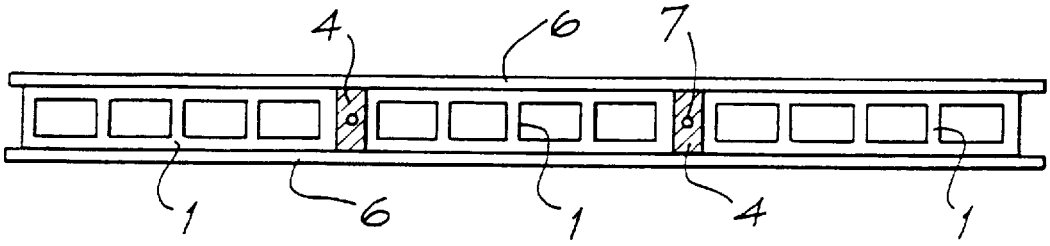
FIG. 6 is a section of a cellular grid wall showing the separate elements with the walling units 1 shown as made of masonry.
Figure 7:
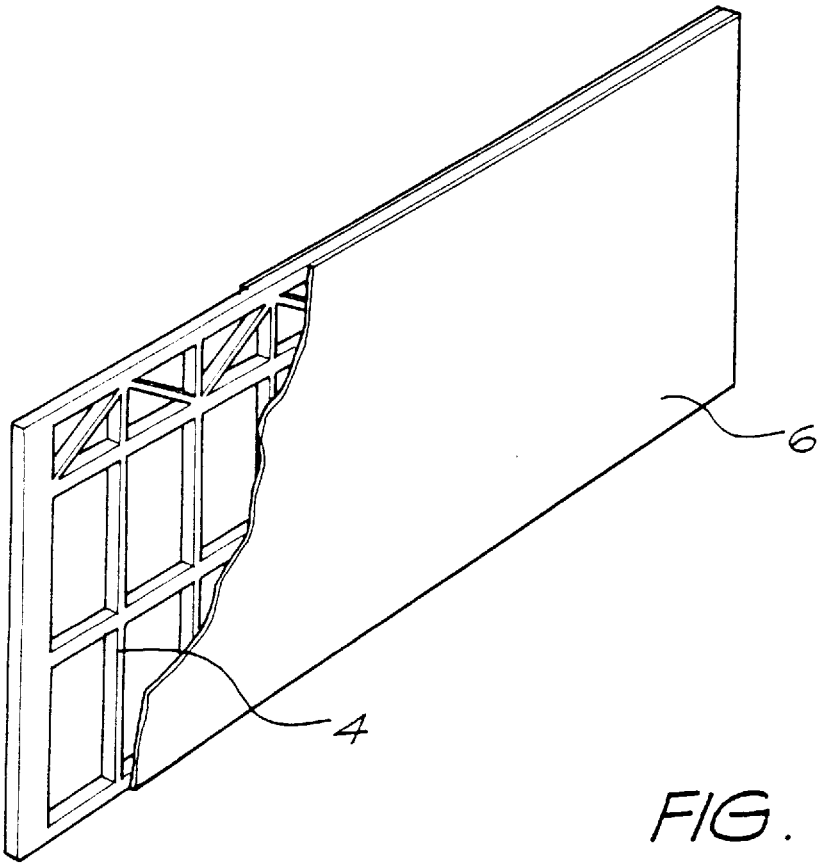
FIG. 7 is an isometric view of a multi cellular grid wall with the cement render 6 cut away to show the cellular grid frame 4. (The walling units are not shown in this drawing for clarity).

In a structure such as that shown in FIG. 7 the cement render 6, made up mainly from a basic mixture of Portland cement and suitable aggregate such as sand, offers considerable bracing support for the concrete grid 4 in the form of a continuous surface skin that has significant compressive, and in some cases, tensile capacities. When the render 6 is bonded to the walling units 1 this action is further and greatly enhanced as the two elements combine with each other to brace and strengthen the concrete grid and allow the grid to be spaced further apart. The walling units 1 support both layers or skins of the render 6, joining them via the walling units and assisting the render to resist buckling forces. The walling units also assist in distributing shrinkage stresses in the render more evenly as they have been previously cured.

In fact the three elements, concrete grid 4, walling unit 1 and render 6 can play a very interactive role together with the render 6 in more extreme cases being significant if required. The interaction works in the following way, the reinforced concrete grid 4 is the primary structural element of the wall, the walling unit 1 is used to support the cement render 6 and by bonding to the render, the two jointly assist in bracing the concrete grid members 4, the render on it's own also braces the cellular grid in the manner of a stressed skin.

This effect can be varied by the strength and thickness of the render 6 as well as by adding reinforcement to the render 6, the type of reinforcement could vary considerably and include all types that may be suitable, preferably these could include a fine steel, glass, plastic or polypropylene mesh or fibres in various forms. Reinforcement would also assist in control of any shrinkage in the render layers that could cause unsightly cracks.

This technique of strengthening and reinforcing would be of significant advantage where the wall had a large window or door opening or a truss type beam formed by the concrete grid and additional strength was required over the top of the opening, in fact it could be used to strengthen and more highly stressed part of the wall where required.

It is preferred that the walling unit 1 is made from materials based on Portland cement or clay and that it be preferably hollow to save on weight and materials however it could be made of any material that would give adequate support to the render 6 and not necessarily play any other structural role. It must however be used to separate and preferably combine with and support the two skins or layers of cement render 6 on the surfaces of the sides of the wall.

The render 6 must bond adequately to the primary structure element, the cellular grid 4 and also to the walling unit 1. When the walling units are laid onto the table within the groups that separate the concrete grid members there are narrow gaps between the units themselves and it is the purpose of the render to support and hold these walling units in place, to do this the bond between the walling units and the render must be adequate and this can be enhanced by making the walling unit with a rough surface. The bond between the render and the concrete grid must also be adequate, the most effective and preferred, but not essential way of achieving this is to make the two elements ie., concrete grid 5 and render 6, at approximately the same time or close to the same time so that a wet bond between them is achieved. Bonding of all these elements to one another could be enhanced by the use of bonding agents.

The preferred method of manufacture is as follows:

The walling units 1 are manufactured first and cured prior to being used, these units are in the shape of a brick or block, are hollow and made in a block making machine. Their size can vary considerably but when they become too large the flexibility of structural design diminishes, the optimum size is 290 mm long, 90 mm high with the thickness varying to suit the structural application and wall thickness required. The core holes or voids in the walling units can also significantly vary depending on general requirements, however the greater the void area the greater the weight reductin and subsequent overall cement content reduction becomes.

Next a flat table mould in a horizontal position is then prepared for the manufacture of a cellular grid wall panel, a release agent being sprayed onto the surface of the table. The table mould has the ability to tilt up into a vertical position for the de-moulding process.

A layer of Portland cement render is then evenly spread onto the mould surface in the same configuration as the shape of the prefabricated panel, this can be achieved by hand or mechanical means such as a screed spreader or spray. The thickness of the render on each side can vary, however for economical and practical reasons it is expected but not limited to range between 5 mm and 25 mm thick. For special reasons such as fire resistance, sound attenuation, further weight reduction and other purposes etc., the thickness, reinforcing, types and sizes of aggregates used could all vary considerably.

The walling units 1 are then placed in the desired configuration onto the flat table mould surface, this may be done by hand, however the preferred method is by a Robot machine specially designed for that purpose called a brick or block placing machine. The walling units are now set into the render mortar, there is some displacement of the mortar by the block and this if forced upwards into the narrow gaps between the walling units. These narrow spaces or gaps can vary from an approximate minimum of 4 mm wide upwards depending on the render consistency and other requirements. By spacing the walling units in groups as shown in the drawings larger spaces are left in between the groups of walling units, these spaces or channels are normally in two directions and together form an interconnecting grid of channel sections between and around the groups of walling units 1. The sectional dimensions of the grid members so formed by the channel is controlled in one direction by the depth of the wall units placed on the table. In the other, ie., the thickness of the grid member (width of channel formed by spaces between wall units) can vary from an approximate minimum of 20 mm to whatever the requirements may be.

Formwork (not shown) is then positioned around the walling units 1 to the desired configuration of the prefabricated panel. Steel reinforcement is then placed in these channels including a channel formed around the perimeter by the formwork edgeboard that forms the outline of the overall dimensions of the wall panel.

The channels are then filled with a high strength Portland cement based concrete, the consistency of which is such that it is able to flow around the reinforcing but not far into the narrow spaces between the walling units themselves or into the hollow cores of the walling units. In some instances these core holes will have to be masked off to prevent the concrete from filling them. The structure is thus surrounded by a reinforced concrete frame.

When this is completed another layer of cement render is spread over the entire panel form and finished off smooth, this material like the other render also pushes down into the narrow joints or gaps between the walling units. The grid member and the upper layer of render could also be poured simultaneously if this is more desirable, however the render materials on both sides of the wall such as cement content and aggregate sizes would need to be consistent or compatible with the grid concrete materials.

The panel is then cured for the desired amount of time, when ready the mould table is tilted up into the vertical plane and the completed panel removed to storage.

The walling units are pre cured to reduce shrinkage and to increase strength before use and can be quite weak as they perform little structural function and are preferably laid in a staggered or stretcher bond configuration within each grouping, this is done to remove any planes of weakness that could develop if a simple vertical stack bonding pattern were used. It is also preferable that the walling unit blocks have a rough texture so that bonding between them and the render is satisfactory as the render supports and holds in position the walling units.

The cement render strength and thickness is also relative to the effect that is structurally required, it may also be reinforced in part or whole if required.

It is essential with this method that at least one render coating 6 is applied during the manufacturing sequence and it is optional as to when the other side is added, the most preferred and desirable way is that both are added at the same time ie during the one manufacturing sequence. The render 6 may be reinforced on non reinforced in part or whole.

The grid members are made from very high strength concrete of between 50 mpa–100 mpa but the entire grid only accounts or approximately between 10%–30% of the overall volume of the mass of the wall. Not every grid member may be required to be reinforced.

I claim:

1. A prefabricated reinforced concrete wall structure, the wall structure comprising:

a plurality of groups of walling units, the walling units in each group being spaced apart from one another and the groups of walling units being spaced from one another by a distance substantially greater than a distance between the walling units within each group, a concrete grid formed of a high strength reinforced concrete cast into and filling spaces between the groups of walling units and also surrounding each of the groups of walling units, and a layer of a Portland cement based render on both of two opposed sides of the wall structure bonded to the walling units and to the concrete grid, the layers of render providing the wall structure with two substantially parallel planar opposed surfaces.

2. A wall structure as claimed in claim 1 wherein the walling units are hollow and unfilled.

3. A wall structure as claimed in claim 1 wherein the walling units are arranged in a stretcher bond configuration.

4. A wall structure as claimed in claim 1 wherein the layers of Portland cement render are bonded to the walling units and the concrete grid.

5. A wall structure as claimed in claim 1 wherein the layers of Portland cement render project into gaps between adjacent walling units.

6. A method of constructing a wall structure consisting in the following steps:

(a) forming a plurality of walling units;

(b) laying down a layer of uniform thickness of Portland cement render on a flat surface;

(c) arranging the walling units on the cement render spaced apart but in groups over the whole area of the structure to form channel spaces between and around the groups of walling units to define a grid;

(d) filling said channel spaces with a high strength concrete with the introduction therein of reinforcing means, to form a high strength reinforced concrete grid structure;

(e) spreading a second layer of Portland cement render of uniform thickness over the walling units and the filled channel spaces; and (f) curing the structure.

7. A method as claimed in claim 6 wherein said second layer of render is applied while the concrete in said channel spaces is still in a condition to form a wet bond with the render.

8. A method as claimed in claim 6 wherein said walling units have hollow cores and prior to the filling of said channel spaces said cores are masked to prevent the entry of concrete.

* * * * *